US006930585B2

(12) United States Patent
Kawazoe

(10) Patent No.: US 6,930,585 B2
(45) Date of Patent: Aug. 16, 2005

(54) MINIATURE FUSE

(75) Inventor: Tetsuo Kawazoe, Chiba (JP)

(73) Assignee: Nippon Seisen Cable, Ltd., Tokyo (JP)

( * ) Notice: Subject to any disclaimer, the term of this patent is extended or adjusted under 35 U.S.C. 154(b) by 106 days.

(21) Appl. No.: 10/687,080

(22) Filed: Oct. 16, 2003

(65) Prior Publication Data

US 2004/0160301 A1 Aug. 19, 2004

(30) Foreign Application Priority Data

Feb. 19, 2003 (JP) ..... 2003-041245

(51) Int. Cl.[7] ..... H01H 85/175
(52) U.S. Cl. ..... 337/186; 337/187
(58) Field of Search ..... 337/187, 186, 337/227, 228, 246; 29/623

(56) References Cited

U.S. PATENT DOCUMENTS 4,224,592 A * 9/1980 Urani et al. ..... 337/198
4,349,804 A * 9/1982 Gaia ..... 337/198
4,394,638 A * 7/1983 Sian ..... 337/264
4,417,226 A 11/1983 Asdollahi et al.
4,531,806 A * 7/1985 Hsieh ..... 439/621
4,604,602 A * 8/1986 Borzoni ..... 337/264
4,608,548 A * 8/1986 Borzoni ..... 337/201
4,670,729 A * 6/1987 Oh ..... 337/262
4,712,081 A * 12/1987 Bosley ..... 337/266
6,359,543 B2 * 3/2002 Endo et al. ..... 337/198
6,452,474 B1 * 9/2002 Oh ..... 337/278
6,486,766 B1 * 11/2002 Reid et al. ..... 337/186
6,496,096 B2 * 12/2002 Kondo et al. ..... 337/234
6,542,063 B2 * 4/2003 Kawashima et al. ..... 337/203

FOREIGN PATENT DOCUMENTS

EP 899820 A2 * 3/1999 ..... H01R/9/26

* cited by examiner

*Primary Examiner*—Anatoly Vortman
(74) *Attorney, Agent, or Firm*—John P. White, Esq.; Cooper & Dunham LLP

(57) ABSTRACT

A box-like case for a miniature fuse comprises a first and second plastic assembling members having the same form, each of the assembling members has a base part provided with a pair of first grooves, a side plate part formed as a unitary one-piece structure as the base part to form a square space together with the base part, a wall part provided at an end surface of the side plate part, where the space is exposed, and projecting from the end surface, and a second groove entering inside from the end surface, the wall part and the second groove is formed such that a position of the wall part of one of the first and second assembling members corresponds to a position of the second groove of the other assembling member when the end surfaces of the base parts of the assembling members are opposed.

4 Claims, 2 Drawing Sheets

MINIATURE FUSE

CROSS-REFERENCE TO RELATED APPLICATIONS

This application is based upon and claims the benefit of priority from the prior Japanese Patent Application No. 2003-41245, filed Feb. 19, 2003, the entire contents of which are incorporated herein by reference.

BACKGROUND OF THE INVENTION

1. Field of the Invention

This invention relates to a miniature fuse to be used as an attachment to a printed wiring board.

2. Description of the Related Art

To control various electric apparatuses, electronic circuits formed by connecting printed wiring boards each provided with various electronic parts are often used. In such electronic circuits, due to malfunction of circuit parts, a large current flows into the circuit parts, which causes very dangerous situations such as abnormal heat generation, or malfunction of electric apparatuses due to breakdown of the circuit parts.

Therefore, in such electronic circuits, a miniature fuse is attached onto the printed wiring boards. When a large current flows as described above, the fuse blows out and thereby a circuit current breaks to prevent the above dangerous situations.

As conventional art of such miniature fuses, a fuse disclosed in U.S. Pat. No. 4,417,226 is well known.

In the miniature fuse disclosed in the above document, a base and a cap form a case, and a fuse element is enclosed in a chamber of the case. Each of the base and the cap is formed of a plastic molded part manufactured by a dedicated mold.

In the above conventional miniature fuse, the forms of the base and the cap are different from each other. Therefore, it is necessary to manufacture different respective molds for them, which increases the manufacturing cost.

Further, when the fuse is assembled, a pair of leads, to distal ends of which a fuse element is attached, is inserted through a pair of lead-inserting holes provided at the base, and the base is covered with a cap. This increases the number of steps of assembly, and also increases the manufacturing cost.

BRIEF SUMMARY OF THE INVENTION

This invention has been made in consideration of the above circumstances. The object of the invention is to provide a miniature fuse which can reduce the manufacturing cost.

According to one embodiment of this invention, there is provided a miniature fuse including: a box-like case having a first and second plastic assembling members having the same form, each of the assembling members having a base part provided with a pair of first grooves, each of which has a semicircular cross section, in parallel with each other along an end surface, a side plate part formed as a unitary one-piece structure as the base part to form a square space together with the base part, a wall part provided at an end surface of the side plate part, where the space is exposed, and projecting from the end surface, and a second groove entering inside from the end surface, the wall part and the second groove being formed such that a position of the wall part of one of the first and second assembling members corresponds to a position of the second groove of the other assembling member when the end surfaces of the base parts of the assembling members are opposed, the case being assembled by fitting the wall part of one of the assembly members into the groove of the other, the spaces of the assembling members forming a chamber, and the first grooves of the assembling members forming a pair of lead-inserting holes; a pair of leads provided through the pair of the lead-inserting holes; and a fuse element attached to distal ends of the pair of leads, the distal ends being located in the chamber.

The end surface of each of the base parts of the first and second assembling members may be provided with a first projection and a hole which is located in a position corresponding to a position of the first projection of the other assembling member, the first projection and the hole being used for positioning when the box-like case is formed.

A second projection may be provided in the middle of each of the leads, and a hollow which corresponds to the second projection may be provided in each of the first grooves.

A depth of a part of a surface in each of the base parts, which is opposed to the space, may be reduced, such that a predetermined space is generated between the base parts of the first and second assembling members when the box-like case is formed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

This invention will now be detailed with an embodiment, with reference to drawings.

Figure 1:
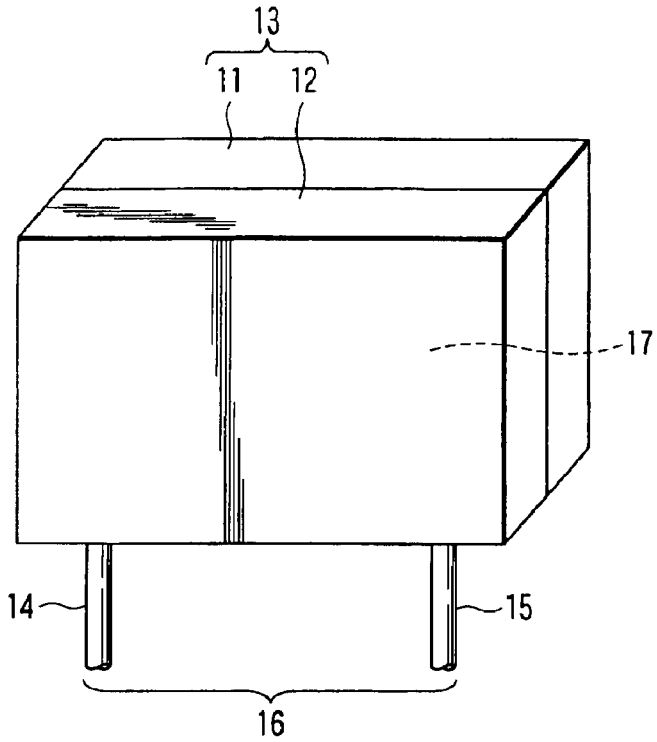
FIG. 1 is a perspective view showing an exterior form of a whole miniature fuse according to an embodiment of the present invention.

FIG. 1 is a perspective view showing an exterior form of a whole miniature fuse according to an embodiment of the present invention. A miniature fuse of the embodiment comprises a box-like case 13 obtained by assembling two plastic assembling members 11 and 12, and a fuse element assembly 16 having a pair of leads 14 and 15. A chamber 17 to contain a fuse element is provided inside the case 13.

Figure 2:
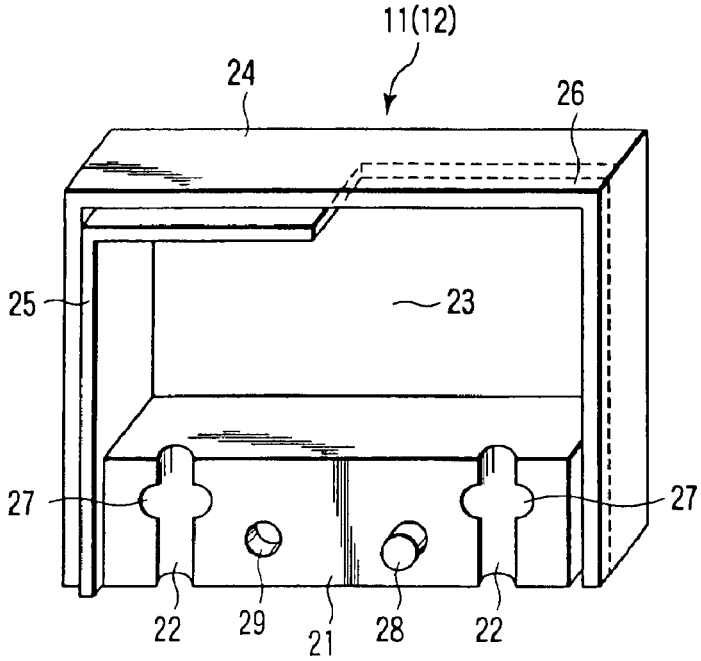
FIG. 2 is a perspective view showing a form of an assembling member shown in FIG. 1.

The two assembling members 11 and 12 have the same form, and each of them has a structure as shown in FIG. 2 being a perspective view thereof. Specifically, a base part 21 is provided to each of the assembling members 11 and 12. The base part 21 is provided with a pair of grooves 22, 22, which are parallel to each other, along an end surface thereof. Each of the grooves 22 has an almost semicircular cross section. Each of the assembling members 11 and 12 also has a side plate part 24 that is formed as a unitary one-piece structure as the base part 21 to form a square space 23 together with the base part 21. Further, in an end surface of the side plate part 24 on the side where the space 23 exposes, a wall part 25, which projects from the end surface by a predetermined distance and has a predetermined thickness, is provided along a left half of the end surface, as viewed in FIG. 2. Further, a groove 26 entering the inside of the assembly member from the end surface is provided along a right half of the end surface of the side plate part 24, as viewed in FIG. 2. The groove 26 enters inside from the end surface by almost the same length as a length by which the wall part 25 projects from the end surface. The groove 26 reduces the thickness of the side plate part 24 by almost the same quantity as the thickness of the wall part 25.

Further, a hollow 27 is provided in the middle of each of the grooves 22, 22. The hollow 27 receives a projection (described below) formed in the middle of each of the leads 14 and 15 shown in FIG. 1. The hollows 27 of the grooves 22, 22 are engaged with respective projections of the leads 14 and 15, and thereby prevent the leads 14 and 15 from falling off or rotating at the time of, or after, assembly.

Furthermore, the end surface of the base portion 21 is provided with a projection 28 and a hole 29 for preventing misalignment of the assembling members 11 and 12 when the members 11 and 12 are assembled into the case 13 (shown in FIG. 1).

Figure 3:
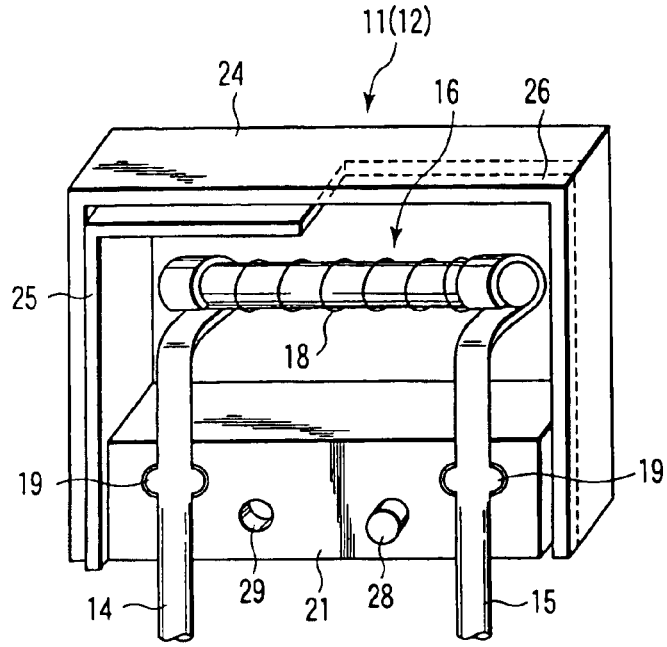
FIG. 3 is a perspective view showing the fuse element assembly in FIG. 1 together with the assembling members.

When a miniature fuse is assembled by using the above assembling members 11 and 12, the fuse element assembly 16 as shown in FIG. 3 being a perspective view thereof is also prepared besides the assembling members 11 and 12. As described above, the fuse element assembly 16 is provided with the pair of leads 14 and 15. Distal ends of the leads 14 and 15 are curled, and attached to a fuse element 18. Further, a projection 19 is formed in the middle of each of the leads 14 and 15 by pressing or the like.

The leads 14 and 15 are fitted into the grooves 22, 22 of the assembly member 11 or 12 such that the fuse element 18 attached to the distal ends of the leads 14 and 15 is located in the space 23. Then, case 13 is assembled by fitting the wall part 25 of one of the assembly members into the groove 26 of the other, in the state where the assembly members 11 and 12 face each other such that the end surfaces of the their base parts 21 are opposed to each other. At the time of assembling, the projection 28 of one of the assembling members 11 and 12 is inserted into the hole 29 of the other, and thereby misalignment of the assembling members 11 and 12 is prevented.

By assembling the case 13, the spaces 23 of the assembling members 11 and 12 form the chamber 17 for containing the fuse element 18, and the pairs of the grooves 22, 22 form two lead-inserting holes through which the leads 14 and 15 run.

After assembly, the case 13 is finished by applying adhesive to a joint of the assembly members 11 and 12, or welding the members 11 and 12 together by means of high-frequency welding and the like, to prevent separation of the members.

In the meantime, when the fuse element 18 blows out, the temperature and pressure in the chamber 17 rapidly increase, therefore sometimes the case 13 is broken if it is sealed.

To prevent it, in the miniature fuse of the embodiment, the depth of a part of a surface of each base part 21 opposed to the space 23 is reduced, such that a predetermined space exists between the base parts 21 when the assembling members 11 and 12 have been assembled into the case 13.

Figure 4:
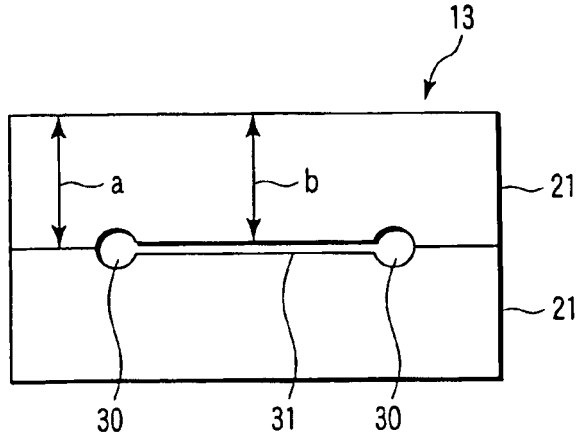
FIG. 4 is a front view of an example of base parts in the fuse shown in FIG. 1, viewed from a chamber side.
Figure 5:
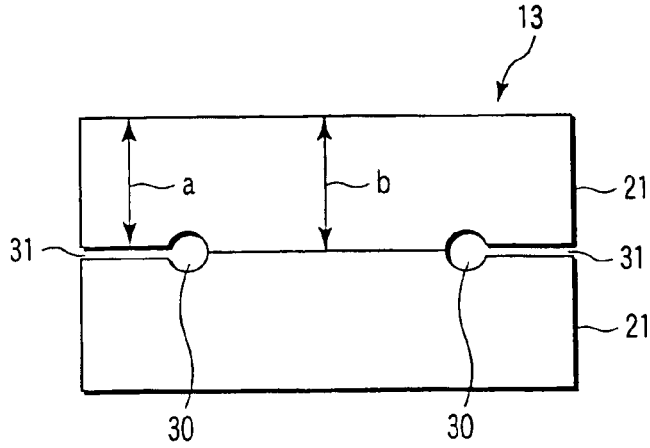
FIG. 5 is a front view of another example of the base parts in the fuse shown in FIG. 1, viewed from the chamber side.

FIGS. 4 and 5 are front views of two examples of the base parts 21 of the case 13 viewed from the chamber 17 side.

FIG. 4 shows an example in which, in the surface of each of the base parts 21 opposing the space 23, depth "b" of a portion between the grooves 22, 22 is set to be smaller than depth "a" of the other portions, such that a predetermined space 31 is generated between a pair of lead-inserting holes 30, 30 formed by the grooves 22, 22 of the assembling members 11 and 12.

In contrast with the example of FIG. 4, FIG. 5 shows an example in which, in the surface of each of the base part 21 opposing the space 23, depth "a" of portions other than a portion between the grooves 22, 22 is set to be smaller than depth "b" of a portion between the grooves 22, 22, such that predetermined spaces 31 are generated in the portions other than the portion between lead-inserting holes 30, 30.

As described above, in the miniature fuse of the embodiment, the case 13 is formed by using the two assembling members 11 and 12 having the same form. Therefore, it is possible to manufacture the assembling members 11 and 12 by using the same mold, thus it is possible to reduce the number of parts and the manufacturing cost.

Further, the fuse can be assembled by fitting a pair of leads 14 and 15 of the fuse element assembly 16 into the grooves 22, 22 provided at the base parts 21 of the assembling members 11 and 12, without putting a pair of leads through a pair of lead-inserting holes provided at a base as in the conventional art. It is thus possible to reduce the number of assembly steps in comparison with the conventional art, and also thereby reduce the manufacturing cost.

The present invention is not limited to the above embodiment, and various modifications are possible as a matter of course. For example, as shown in FIG. 2, although in the above embodiment the wall 25 is formed in the left half of the member in the drawing and the groove 26 is formed in the right half, the wall 25 may be formed in the right half and the groove 26 in the left half. In short, the assembling members 11 and 12 may have any structures as long as they have the same form. Further, the positions of the projection 28 and the hole 29 formed in the base part 21 are not limited to those shown in FIG. 2.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A miniature fuse comprising:

a box-like case including a first and second plastic assembling members having the same form, each of the assembling members having a base part provided with a pair of first grooves, each of which has a semicircular cross section, in parallel with each other along an end surface, a side plate part formed as a unitary one-piece structure as the base part to form a square space together with the base part, a wall part provided at an end surface of the side plate part, where the space is exposed, and projecting from the end surface, and a second groove entering inside from the end surface, the wall part and the second groove being formed such that a position of the wall part of one of the first and second assembling members corresponds to a position of the second groove of the other assembling member when the end surfaces of the base parts of the assembling members are opposed, the case being assembled by fitting the wall part of one of the assembly members into the groove of the other, the spaces of the assembling members forming a chamber, and the first grooves of the assembling members forming a pair of lead-inserting holes;

a pair of leads provided through the pair of the lead-inserting holes; and a fuse element attached to distal ends of the pair of leads, the distal ends being located in the chamber.

2. A miniature fuse according to claim 1, further comprising a first projection provided in the end surface of each of the base parts of the first and second assembling members, and a hole which is located in a position corresponding to a position of the first projection of the other assembling member, the first projection and the hole being used for positioning when the box-like case is formed.

3. A miniature fuse according to claim 1, further comprising a second projection provided in the middle of each of the leads, and a hollow which corresponds to the second projection being provided in each of the first grooves.

4. A miniature fuse according to claim 1, wherein a depth of a part of a surface in each of the base parts, which is opposed to the space, being reduced, such that a predetermined space is generated between the base parts of the first and second assembling members when the case is formed.

* * * * *